United States Patent [19]

Ehlenbeck

[11] 3,958,954

[45] May 25, 1976

[54] CONCRETE WELDMENT

[76] Inventor: Gary James Ehlenbeck, 4530 N. Oakland Ave., Milwaukee, Wis. 53211

[22] Filed: June 13, 1975

[21] Appl. No.: 586,715

[52] U.S. Cl. ..... 29/183.5; 29/183; 52/583; 52/758 B

[51] Int. Cl.[2] ..... E04B 1/21

[58] Field of Search ..... 52/758 B, 224, 225, 52/226, 229, 598, 599, 583; 29/183, 183.5, 191, 191.4

[56] References Cited

UNITED STATES PATENTS

| | | | |
|---|---|---|---|
| 2,188,445 | 1/1940 | Saxe | 52/758 B |
| 2,607,450 | 8/1952 | Horowitz | 52/758 B |
| 2,611,262 | 9/1952 | Dodson et al. | 52/583 |
| 2,664,740 | 1/1954 | Cochrane | 52/583 |

FOREIGN PATENTS OR APPLICATIONS

| | | | |
|---|---|---|---|
| 622,687 | 6/1961 | Canada | 52/583 |
| 2,046,393 | 6/1972 | Germany | 52/598 |

*Primary Examiner*—Arthur J. Steiner
*Attorney, Agent, or Firm*—Andrus, Sceales, Starke & Sawall

[57] ABSTRACT

An improved weldment is suitable for embedment along the edges of concrete members so as to permit welding joinder of adjacent members. The weldment is formed of sheet steel and includes an elongated central portion which is exposed when the weldment is emplaced. The central portion terminates in fold lines from which extend tapered tails that are embedded in the material. The fold lines are angularly displaced in a generally converging fashion and the tails are bent out of the plane of the central portion.

16 Claims, 9 Drawing Figures

CONCRETE WELDMENT

FIELD OF THE INVENTION

The present invention relates to a joinder element for use in static structures.

BACKGROUND OF THE INVENTION

Concrete is a widely used building material because of its structrual properties, ready availability, and low cost. In many cases, mixed concrete is brought to the job site, poured into forms put up there and allowed to set. However, the use of precast members is becoming increasingly common due to ease and economy in fabrication and assembly. These members are manufactured off the job site and then hauled to the location and erected to form, for example, a wall or deck.

A typical prefabricated member, such as a beam, has a slab or load bearing surface and may include one or more stems containing reinforcing or prestressed strands. To form a building element, the members are positioned so that the edges of the slabs are abutting.

It will be appreciated that relative movement may occur between members forming a portion of a structure. For example, when a deck formed of beam-like members is employed in a building, relative horizontal movement tends to occur between the members in response to wind forces exerted on the vertical walls of the building. Vertical movement between the members may occur by reason of the expansion produced by the sun shining on one portion of a roof deck but not on another or by snow loads existing on one portion of a roof deck but not on another portion.

In order to prevent or lessen such relative movement and to form the individual members into a unitary structure, means may be provided to join the adjacent edges of the members together. Metal pieces may be embedded in the edge of the slab so that when the members are erected, the metal pieces are opposing and may be welded together to provide the necessary joinder. These metal pieces are commonly called weldments.

At the present time, weldments are commonly formed of pieces of the cylindrical reinforcing bars in common use in precast concrete plants. The reinforcing bar is bent in a generally U-shaped configuration. The parallel arms of the bent reinforcing bar are embedded in the concrete and the intermediate web or base is exposed along the edge of the member.

It will be appreciated that the location of the weldment in the concrete of the slab becomes quite critical to the structural strength and properties of the weldment and joinder of the members.

Ideally, the reinforcing bar should be embedded in the middle of the slab in order to insure proper transmission and absorption of the forces received by the weldment.

The intermediate web of the reinforcing bar weldment is usually located on the upper corner of the deck so as to be accessible to a welder stranding on the deck. The parallel portions of a reinforcing bar weldment must therefore slant downward into the slab in order to insure proper embedment and an adequate cover of concrete.

However, during the positioning of the reinforcing bar, once the bar is immersed in the concrete, it thereafter becomes impossible to determine the location of the parallel portions of the bar in the slab. This is particularly true in in view of the fact that the exposed portion of the weldment is cylindrical and thus gives no indication as to whether the remaining poritons of the weldment are properly located. Consistent, proper positioning of the reinforcing bars cannot be assured.

Because of the difficulties in locating reinforcing bar weldments in the slab, the weldments are commonly not embedded sufficiently and pull out of the slab under load, particularly loads applying vertical shear forces to the weldments.

While the arms of the reinforcing bar may be kinked so as to permit the arms to lie parallel to the surface of the slab while positioning the base at the upper corner of the slab, this is often not done or, if done, is not done to the required dimensions so that insufficient anchoring again occurs.

Another shortcoming of reinforcing bar weldments is that the web portion of the reinforcing bar is easily covered with concrete or grout during fabrication of the member. This makes it difficult to find the reinforcing bars in the field.

Even when the reinforcing bar weldments are both embedded and exposed in the proper manner, the welding of the reinforcing bars to join the members together is difficult since the bars are formulated to exhibit the necessary mechanical, reinforcing properties and not for weldability. When weld failure occurs, it is an abrupt brittle failure at an end of the portions heated by the torch or electrode during welding.

Due to the shortcomings of reinforcing bar stock as weldments, specially fabricated weldments have been employed. These have typically comprised a plate having anchors stud welded to the back. While these devices do overcome many of the shortcomings of the reinforcing bar weldments, they suffer other disadvantages. Such weldments tend to be difficult and expensive to fabricate and/or exhibit poor weight to load ratios. They are similarly difficult and expensive to handle and store.

SUMMARY OF THE PRESENT INVENTION

It is, therefore, the object of the present invention to provide an improved weldment suitable for embedment in concrete members. A salient feature of the improved concrete weldment of the present invention is that the position of the embedded portions of the weldment can be easily ascertained by visual inspection of the exposed portion. Proper, consistent positioning of the weldment in the slab is thus assured and maximum vertical shear resistance properties of the weldment realized. The dimensions of the weldment are reduced at locations where the vertical shear loading on the weldment is lessened. These reduced dimensions permit the amount of cover to be correspondingly increased, further insuring adequate embedment.

The weldment provides a planar surface which resists inadvertant covering with concrete or grout. The weldment lends both ease of welding and ductile properties to the joinder of the members, thereby improving the properties of the joint.

The weldment of the present invention is economical to fabricate, handle, ship, and store.

The weldment also provides a means by which adjacent members having different cambers can be pried into alignment. Heretofore aligning the members has resulted in a spalling of the concerete by the pry bar or has required removal of portions of one of the members in order to provide the necessary fulcrum.

The weldment of the present invention is formed of sheet stock rather than cylindrical stock such as reinforcing bars. The weldment includes a central portion presenting a flat surface disposed at an angle to the perpendicular and exposed when the weldment is in place. The central portion may contain a slot useful in prying the concrete members into alignment or for embracing an insert which improves horizontal shear properties of the weldment. The central portion terminates at a pair of fold lines. Tapered tails, bent at an angle to the plane of the central portion, extend from the fold lines for embedment in the concrete member. The fold lines are displaced in a generally converging manner.

Inasmuch as the exposed planar central portion of the weldment bears a fixed relationship to the embedded tails of the weldment, the position of the tails and proper embedment of the weldment can be easily ascertained and assured by examination of the position of the exposed central portion. The use of sheet metal stock and the configuration of the weldment lends economy to the fabrication, handling, shipping, and storing of the product.

DESCRIPTION OF THE PREFERRED EMBODIMENT

Figure 1:
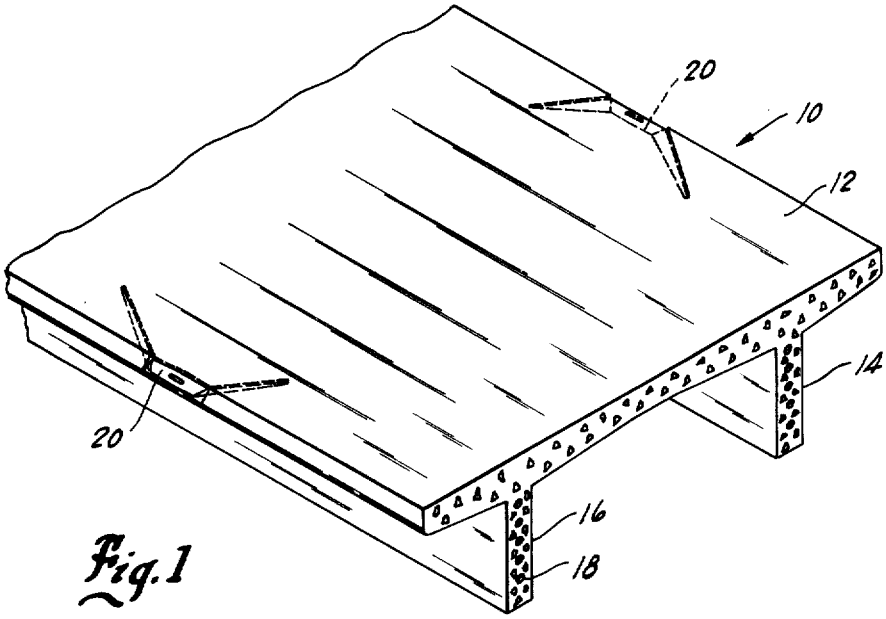
FIG. 1 is a partial perspective view of a concrete member containing weldments of the present invention.

In FIG. 1, the numeral 10 identifies a concrete member. Member 10 is shown as a beam and includes a longitudinally extending load bearing slab 12 and laterally spaced stems 14 and 16 which support slab 12. The configuration shown is that commonly termed in the industry as "double tee." Slab 12 may typically be 2 inches thick. Stems 14 and 16 may contain prestress strands 18 which improve the structural properties of the beam.

In order to join beam 10 to adjacent beams, weldments 20 are embedded along the edge of slab 12. Weldments 20 are typically spaced every 8 to 10 feet along the edges of slab 12.

Weldments 20 may be formed of bent sheet material, typically of a thickness of approximately 3/16 inch. A low carbon steel exhibiting the desired properties of ductility and weldability may comprise the sheet material for weldment 20. Weldment 20 includes central portion 22 terminating at each end in a fold line 24 from which extend pointed tails 26.

For reasons of manufacturing economy, it has been found desirable to use coil stock in the fabrication of weldment 20 and to form weldment 20 by a pair of parallel cuts made diagonally across the stock. This gives weldment 20 the shape of a greatly elongated diamond of lozenge most clearly seen with the weldment in its unbent state. A usual overall length of weldment 20 in its unbent condition is 20 to 30 inches.

Central portion 22 of weldment 20 may present an elongated planar surface which is slightly wider at the center than at the ends because of the diamond shape of weldment 20. Central portion 22 is typically 4 to 8 inches long and approximately 1½ inches wide. Central portion 22 may contain a slot 28 approximately 1½ inches long and ⅜ inches wide. Slot 20 lies on the center line extending between the points of tails 26 and is used for purposes hereinafter described.

Tails 26 are tapered from fold lines 24 to points at their ends. This provides desired weight to load ratios to weldment 20 and provides increased concrete cover to the weldment, as hereinafter described.

Figure 2:
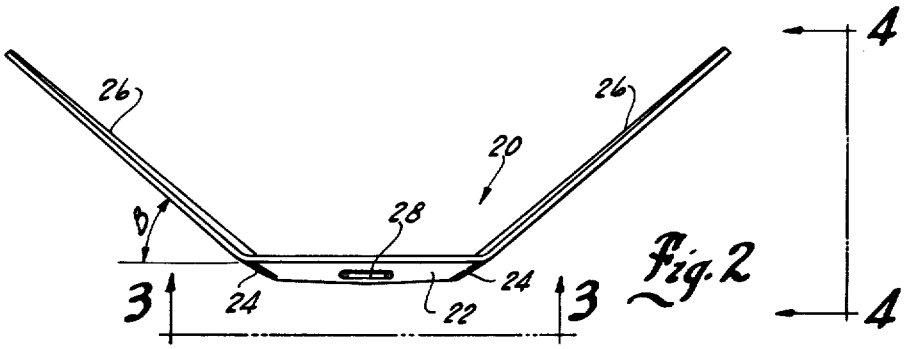
FIG. 2 is a plan view of the weldment of the present invention.
Figure 3:
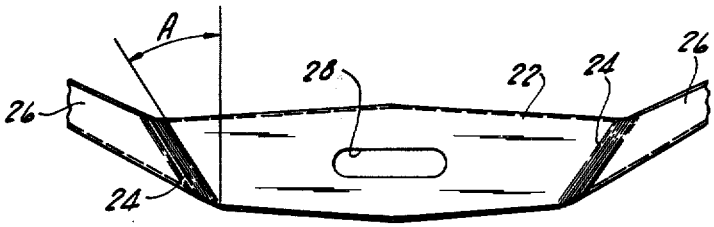
FIG. 3 is a partial front view of the weldment of the present invention taken in the plane of the exposed surface of the weldment.

Fold lines 24 at either end of central portion 22 lend certain important angular configurations to weldment 20. The first of these is the angular orientation of fold lines 24 themselves. This angular displacement of fold lines 24 may be defined with respect to a perpendicular to the center line of central portion 22. When so defined, the angular orientation is identified in FIG. 3 by the letter A. The second angular configuration found at fold lines 24 is the angular bend of tails with respect to the plane of central portion 22, identified by the letter B in FIG. 2.

In regard to the angular orientation A of the fold lines, it will be appreciated that in order to provide a vertical projection to tails 26 for resisting vertical shear forces applied to weldment 20, it is necessary that fold lines 24 be angularly displaced from the perpendicular.

The greater the angular displacement, the greater the vertical projection. However, as the angular displacement of fold lines 24 increases, there is a corresponding loss in horizontal projection, as well as increased difficulty in embedding weldment 20 in the concrete of member 10 due to the increased vertical projection.

Figure 4:
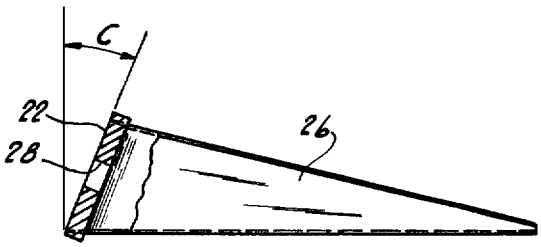
FIG. 4 is a partially broken away side view of the weldment of the present invention taken along the line 4—4 of FIG. 2.

Further, when taken in conjunction with the angle B through which the tails 26 are bent, the angular orientation of fold lines 24 determines the angle at which the planar surface of central portion 22 is positioned when weldment 20 rests on a flat, horizontal surface. This is shown as the angle C in FIG. 4. For a given angle B of tails 26, as angle A increases, the angle C at which planar surface of central portion 22 lies, becomes greater so that the planar surface becomes less vertical.

It has been found that a displacement of between 20° and 60° may be employed as angle A. An angular displacement of about 45° is preferred.

The amount of angular bend B to tails 26 is most particularly determinative of the amount of horizontal projection provided by weldment 20 in the longitudinal and latitudinal directions of slab 12. It also determines to some extent the vertical projection of tails 26 and the angular position of the planar surface of central portion 22.

The angle B of tails 26 may vary from 35° to 70° with an angle of about 50° being preferred. It has been found undesirable to use angles greater than 70° because the amount of concrete, particularly at the lower edges of tails 26, then becomes decreased to the point where vertical shear properties of the weldments are lessened. With small amounts of concrete between the tails there is a tendency for a chunk of concrete to fracture at the lower edges of the tails and pull out of member 10 under vertical loading.

It has been found preferable to employ an angular orientation A and tail bend angle B such that the planar surface of central portion 22 is angularly displaced 20° to 30° from the perpendicular, i.e., angle C equals 20° to 30°.

As noted supra, weldments 20 are typically formed by stamping and bending coil or strip stock lending ease and economy to their fabrication. The configuration of weldments 20 facilitates their nesting and similarly lends ease and economy to their storage and shipment.

In use, a mold is prepared for member 10 which includes prestress strands 18 in stems 14 and 16 and a mesh reinforcement, if necessary, in slab 12. Weldment 20 may be placed in the mold and concrete thereafter poured in the mold to fabricate the member. In the alternative, the weldment may be driven to the concrete after it is poured in the mold but before the concrete sets up. Any disruptions incurred by driving weldments 20 into the concrete of slab 12 may be smoothed over with a trowel.

Weldment 20 is typically positioned so that the upper edge of the central portion 22 of weldment 20 is flush with the upper edge of slab 12. This positions the lower portions of central portion 22 greater than 1 inch below the exposed surface of the slab and insures that the embedment of weldment 20 is sufficient to resist vertical shear forces without pulling out of the concrete. The tapered nature of tails 26 increases the cover of concrete over weldment 20 as the distance from central portion 22 increases. This further insures adequate covering of weldment 20.

Regardless of the manner in which weldment 20 is placed in member 10, the position of weldment 20 is slab 12 may be easily ascertained by examining the orientation of the exposed planar surface of central portion 22. The planar nature of central portion 22 renders it unlikely that it will be covered with concrete or grout during the fabrication of member 10.

After the concrete of member 10 has set, the member is removed from the mold, transported to the job site and erected so that the edges of slab 12 are in abutment with other similar members, with the weldments 20 of the members opposing each other.

Figure 5:
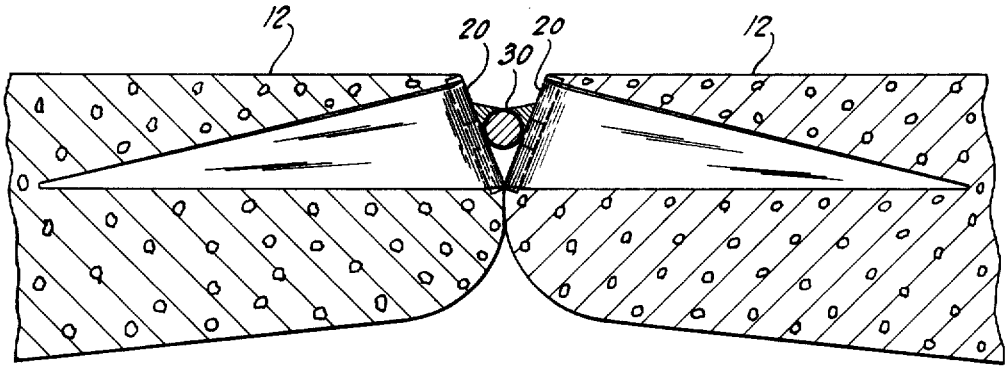
FIG. 5 is a partial cross sectional view of a pair of concrete members containing the weldment of the present invention showing the joinder of the members by the weldments.
Figure 6:
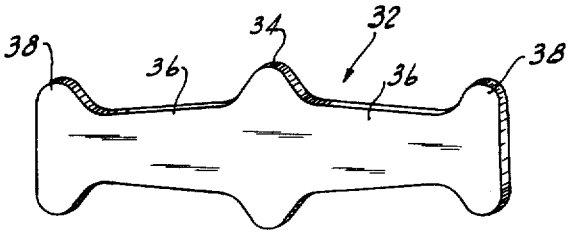
FIG. 6 is a perspective view of an insert suitable for use in conjunction with the weldment of the present invention to improve its structural properties, the insert being shown in its unfolded condition.

Weldments 20 are then welded together to join members 10 into an integrated structure such as a deck, as shown in FIG. 5. If desired, a reinforcing bar slug 30 may be placed between the exposed surfaces of weldment 20 to facilitate the welding.

It frequency arises that the longitudinal cambers of members 10 differ so that the members are out of alignment. For example, the beams of a horizontal deck may be out of vertical alignment due to camber variations. Should this occur the end of an offset pry bar may be inserted in slot 28 of weldment 20 in the lower of two adjacent beams. A block is placed on the other beam as a fulcrum and force applied to the pry bar to raise the lower beam into vertical alignment. The beams, when so aligned, are then joined at the weldments.

In many cases, the main shear forces exerted on weldments 20 is a horizontal shear which tends to push one beam longitudinally past an adjacent beam. As this occurs, there is a tendency for the members to move apart as the weldments are pulled from the concrete. In the central portions of a structure such as a deck, this occurs only with great difficulty because of the number of members adjacent the beams undergoing shear forces. However, in the outer beams, pulling apart of the beams may occur.

To obviate this pulling apart and to gain additional shear strength, the insert 32 shown in FIGS. 6 through 9 may be employed. Insert 32 may be formed of the elongated blank of approximately ⅛ inch thick sheet material shown in FIG. 6. Insert 32 contains an enlarged medial portion 34 having neck portions 36 on either side and enlarged ends 38. The lateral dimension of medial portion 34 exceeds the longest dimension of slot 28 in weldment 20. The lateral dimension of neck portions 36 is less than the longest dimension of slot 28. The lateral dimension of terminal ends 38 is such that by cocking the insert, the ends may be made to pass through slot 28. In a typical embodiment insert 32 is 4½ inches long.

Figure 7:
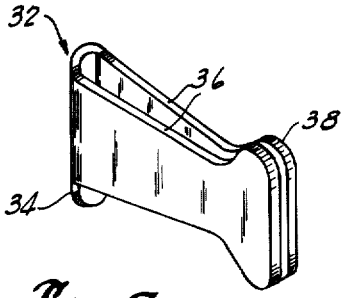
FIG. 7 is a perspective view of the insert of FIG. 6 showing the insert folded and ready for use.

Insert 32 is bent at either side of medial portion 34 to form the generally U-shaped element shown in FIG. 7.

Figure 9:
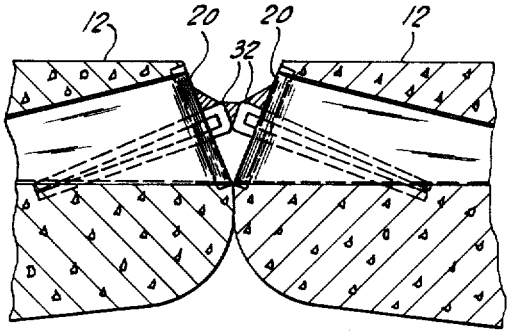
FIG. 9 is a partial cross sectional view of a pair of concrete members showing the joinder of concrete members with weldments containing the inserts shown in FIG. 7.
Figure 8:
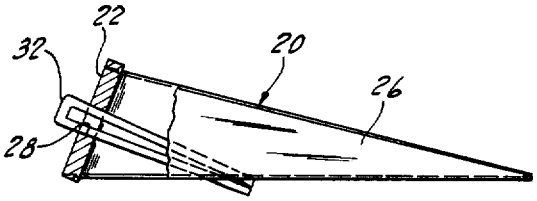
FIG. 8 is a partial side view similar to FIG. 4 showing the insert of FIG. 7 in use.

The bent insert is inserted in slot 28 prior to embedment of weldment 20 in the concrete of beam 10, as shown in FIG. 8. The underside of medial portion 34 is moved into abutment with the planar surface of central portion 22 of weldment 20. After the fabrication and erection of member 10, weldments 20 including the medial portions of insert 32 are welded together, as shown in FIG. 9.

Should forces be exerted on member 10 which tend to pull weldment 20 out of member 10, these forces will be resisted by enlarged ends 38 of insert 32. As medial portion 34 moves into abutment with the sides of slot 28 in central portion 22 responsive to horizontal forces on the beams, the forces are transferred directly to the main portions of the weldment.

Various modes of carrying out the invention are contemplated as being within the scope of the following claims particularly pointing out and distinctly claiming the subject matter which is regarded as the invention.

I claim:

1. An embeddable metallic weldment for joining cementitious members, said weldment being formed from a sheet material of suitable thickness and comprising:

a central plate-like portion presenting a planar, weldable surface disposed at an angle to the perpendicular; and a pair of tails one of which extends from either end of said central portion, said tails being divergingly bent out of the plane of said central portion, said tails being tapered toward their extremities for substantial portions of their length.

2. The weldment according to claim 1 wherein said central portion has a center line running in the direction of the extension of said tails and wherein the bend between said center portion and said tails occur along converging bend lines angularly displaced from a normal to said center line for positioning said tails out of extended alignment with said central portion.

3. The weldment according to claim 2 wherein the bend lines between said center portion and said tails are displaced at an angle sufficient to position the center portion at a preselected angle to the perpendicular when said tails rest on said horizontal surface.

4. The weldment according to claim 3 wherein said bend lines are displaced at an angle of 20° to 60°.

5. The weldment according to claim 4 wherein said bend lines are displaced at an angle of about 45°.

6. The weldment according to claim 3 wherein said tails are bent out of the plane of the central portion at an angle sufficient to position the center portion at a preselected angle to the perpendicular when said tails rest on a horizontal surface.

7. The weldment according to claim 6 wherein said tails are bent an an angle of between 35° and 70° from the plane of said center portion.

8. The weldment according to claim 7 wherein said tails are bent at an angle of about 50° from the plane of said center portion.

9. The weldment according to claim 1 wherein said center portion is wider at the center than at the ends.

10. The weldment according to claim 9 wherein the sheet of material from which said weldment is formed is in the shape of an elongated diamond.

11. The weldment according to claim 1 wherein said center portion is positioned at an angle of between 20° and 30° from the perpendicular when said tails rest on a horizontal surface.

12. The weldment according to claim 1 formed of a sheet of metal possessing good ductility and weldability.

13. The weldment according to claim 1 wherein said center portion contains an elongated slot.

14. The weldment according to claim 11 further including means retained in said slot for resisting removal of the weldment from the cementitious material.

15. The weldment according to claim 14 wherein said means comprises a member having a neck located in said slot, a head of greater dimension than said slot at one end of said neck for retaining said member in said slot, and an expanded terminal end at the other end of said neck for resisting removal of said weldment from cementitious material.

16. The weldment according to claim 15 wherein said member is formed of a generally U-shaped piece of bent sheet material having a pair of necked arms with terminal ends and an intermediate web portion forming said head, said arms having a width less than the length of said slot, said web portion having a width greater than the length of said slot, and said terminal ends having a width greater than that of said necked arms but sufficiently small to permit passage of said terminal ends through said slot.

* * * * *